US008375721B2

(12) United States Patent
Wilbraham

(10) Patent No.: US 8,375,721 B2
(45) Date of Patent: Feb. 19, 2013

(54) BURNERS FOR A GAS TURBINE ENGINE

(75) Inventor: Nigel Wilbraham, West Midlands (GB)

(73) Assignee: Siemens Aktiengesellschaft, Münich (DE)

( * ) Notice: Subject to any disclaimer, the term of this patent is extended or adjusted under 35 U.S.C. 154(b) by 786 days.

(21) Appl. No.: 12/518,516

(22) PCT Filed: Dec. 13, 2007

(86) PCT No.: PCT/EP2007/063864

§ 371 (c)(1),
(2), (4) Date: Jun. 10, 2009

(87) PCT Pub. No.: WO2008/071756

PCT Pub. Date: Jun. 19, 2008

(65) Prior Publication Data

US 2009/0301092 A1 Dec. 10, 2009

(30) Foreign Application Priority Data

Dec. 13, 2006 (GB) ..... 0624865.2

(51) Int. Cl.
*F23R 3/00* (2006.01)
*F23R 3/50* (2006.01)
*F23R 3/54* (2006.01)

(52) U.S. Cl. ..... 60/748; 60/750; 60/743

(58) Field of Classification Search ..... 60/748, 60/750, 743, 737
See application file for complete search history.

(56) References Cited

U.S. PATENT DOCUMENTS 3,618,317 A * 11/1971 Du Bell ..... 60/743
3,808,803 A 5/1974 Salvi
3,938,324 A * 2/1976 Hammond et al. ..... 60/743
4,373,325 A * 2/1983 Shekleton ..... 60/748
4,689,961 A * 9/1987 Stratton ..... 60/748
4,845,940 A 7/1989 Beér
5,020,329 A * 6/1991 Ekstedt et al. ..... 60/743
5,319,935 A 6/1994 Toon et al.
5,816,049 A * 10/1998 Joshi ..... 60/748
6,035,645 A * 3/2000 Bensaadi et al. ..... 60/748
6,151,899 A * 11/2000 Park ..... 60/748
6,244,051 B1 * 6/2001 Zarzalis et al. ..... 60/743
6,532,726 B2 * 3/2003 Norster et al. ..... 60/748
7,086,234 B2 8/2006 Doerr et al.
2006/0021350 A1 * 2/2006 Sanders ..... 60/743

FOREIGN PATENT DOCUMENTS

EP 0636834 A1 2/1995
FR 2626043 A1 7/1989

(Continued)

OTHER PUBLICATIONS

Communication From Russian Patent Office with English Translation, Apr. 3, 2012, pp. 1-15.

*Primary Examiner* — Ted Kim

(57) ABSTRACT

A burner for a gas-turbine engine including a swirler and a combustion chamber is provided. The swirler includes a plurality of vanes arranged in a circle, each adjacent pair of vanes defining a flow slot for the flow of air and fuel into the swirler, the air and fuel is mixed and supplied in swirling form to the combustion chamber. The swirler can also include a partitioning device which divides the flow of air along each flow slot into two air flows. One side of the partitioning device has a fuel-supply port for supplying fuel to one of the two air flows. The relevant air flow causes fuel supplied to the fuel-supply port to form a film of fuel over the relevant side of the partitioning device. The film leaves the relevant side of the partitioning device in a region of high shear between adjacent flows in the burner.

9 Claims, 13 Drawing Sheets

FOREIGN PATENT DOCUMENTS

| | | | |
|---|---|---|---|
| GB | 1302218 | A | 1/1973 |
| GB | 1341223 | A | 12/1973 |
| GB | 1597817 | A | 9/1981 |
| RU | 2145402 | C1 | 2/2000 |
| SU | 308653 | A1 | 1/1983 |
| SU | 1553793 | A1 | 3/1990 |

* cited by examiner

BURNERS FOR A GAS TURBINE ENGINE

CROSS REFERENCE TO RELATED APPLICATIONS

This application is the US National Stage of International Application No. PCT/EP2007/063864, filed Dec. 13, 2007 and claims the benefit thereof. The International Application claims the benefits of Great Britain application No. 0624865.2 GB filed Dec. 13, 2006, both of the applications are incorporated by reference herein in their entirety.

FIELD OF INVENTION

The present invention relates to a burner for a gas-turbine engine.

BACKGROUND OF INVENTION

A typical burner for a gas-turbine engine is shown in FIG. 1. This is taken from U.S. Pat. No. 5,319,935 assigned to Rolls-Royce plc and issued on 14 Jun. 1994. The burner comprises a cylindrical casing 1 attached to a base assembly 2, on which is mounted a radial swirler assembly consisting of first swirler vanes 3 and second swirler vanes 4. These vanes are separated by a flow divider 5. Air enters the swirler assembly in a radial direction, while fuel enters through holes 6 in fuel conduits 7. The resulting swirling fuel and air is guided in two parts by the flow divider 5 into a fuel and air mixing zone 8, the resulting fuel-air mixture then being combusted in a combustion zone 9.

SUMMARY OF INVENTION

In accordance with the invention there is provided a burner for a gas-turbine engine, comprising: a swirler for providing a swirling mix of air and fuel, and a combustion chamber for combustion of the swirling fuel-air mix; wherein the swirler comprises: a plurality of vanes arranged in a circle; a plurality of flow slots defined between adjacent said vanes, each flow slot having an inlet end and an outlet end, wherein, in use of the swirler, air travels along each flow slot from its inlet end to its outlet end and fuel is supplied to the flow slots, thereby to create adjacent the outlet ends of the flow slots said swirling fuel-air mix that is annular in form and travels away from the swirler toward the combustion chamber; and a fuel-placement device, which is arranged to deposit liquid fuel in a region of high shear between adjacent flows in the burner, said high-shear region being due to the creation of a low-pressure region by the swirler, and said adjacent flows being: (a)said annular swirling fuel-air mix, which is located radially adjacent said low-pressure region, and (b) a counter-flow inside flow (a)

created by said low-pressure region, said counter-flow being generally toward the swirler away from the combustion chamber, whereby the liquid fuel from the fuel-placement device is subjected to atomisation due to the high shear.

The low-pressure region may be located radially inside said annular swirling fuel-air mix.

The fuel-placement device is advantageously a partitioning device, whereby the flow of air along each flow slot is divided into first and second air flows, the burner including at least one fuel-supply port for supplying liquid fuel to one of the first and second air flows, wherein, in use of the burner, said one of the first and second air flows causes fuel supplied to said at least one fuel-supply port to form a film of fuel over a first surface of the partitioning device, the partitioning device being arranged such that the film leaves the first surface substantially in said high-shear region.

The partitioning device may have first and second ends, the first end being located in the flow slots, and the partitioning device being extensive generally radially in a region adjacent said first end, curving then in an increasingly axial direction towards its second end.

The burner may further comprise a base assembly which comprises a base member, the base member being curved similarly to the partitioning device, such as to create between the partitioning device and the base member a passage, which decreases in cross-sectional area in a direction of flow of the incoming air.

The other end of the partitioning device may form a lip, which is located adjacent to, or in, a region occupied by said low pressure.

The at least one fuel-supply port may be provided in said first surface of the partitioning device, and the first surface may be a surface of the partitioning device facing the base member.

The at least one fuel-supply port may be provided in a surface of the base member facing the partitioning device.

A plurality of grooves is preferably provided in said first side of the partitioning device, said grooves, in use of the swirler, being substantially extensive along a swirl path of the air proceeding through the partitioning device. Alternatively, a plurality of ridges may be provided on said first side of the partitioning device, said ridges, in use of the swirler, being substantially extensive along a swirl path of the air proceeding through the partitioning device.

A plurality of vanes may be provided between said first side of the partitioning device and said base member, and configured to provide a preferential flow of said fuel-air mix through the partitioning device.

One or more notches may be provided in said first end of the partitioning device, thereby to create a vortex in the air passing over the partitioning device, and one or more fuel-supply ports may be provided in the vicinity of each notch, such that fuel from the one or more fuel-supply ports are affected by the vortex created by the notch.

The swirler may be a radial swirler.

BRIEF DESCRIPTION OF THE DRAWINGS

The invention will now be described, purely by way of example, with reference to the attached drawings, of which.

DETAILED DESCRIPTION OF INVENTION

Figure 1:
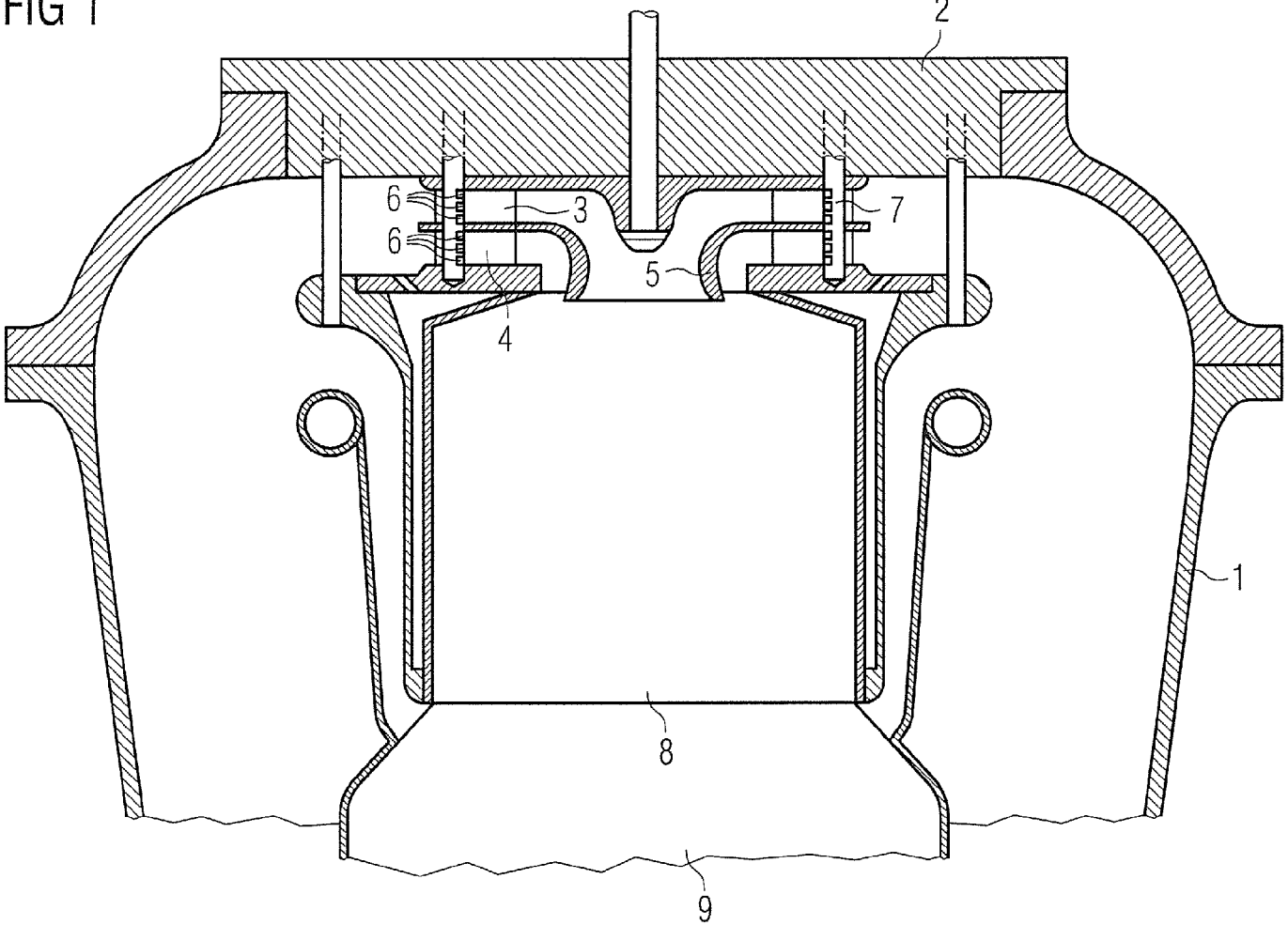
PRIOR ART FIG 1
FIG. 1 is a section through an axial plane of a prior-art burner for a gas-turbine engine.
Figure 2:
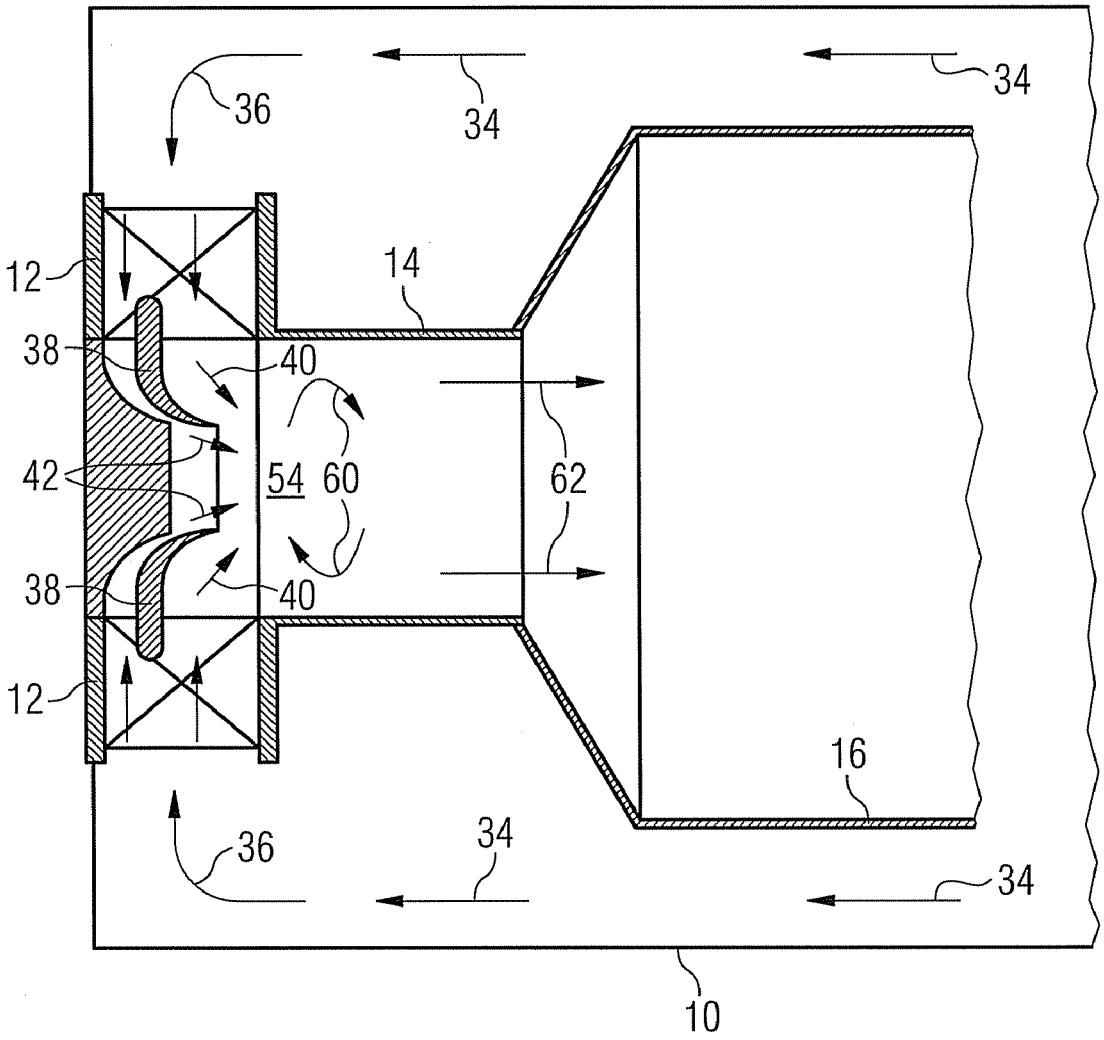
FIG. 2 is a section through an axial plane of a burner in accordance with a first embodiment of the present invention.
Figure 3:
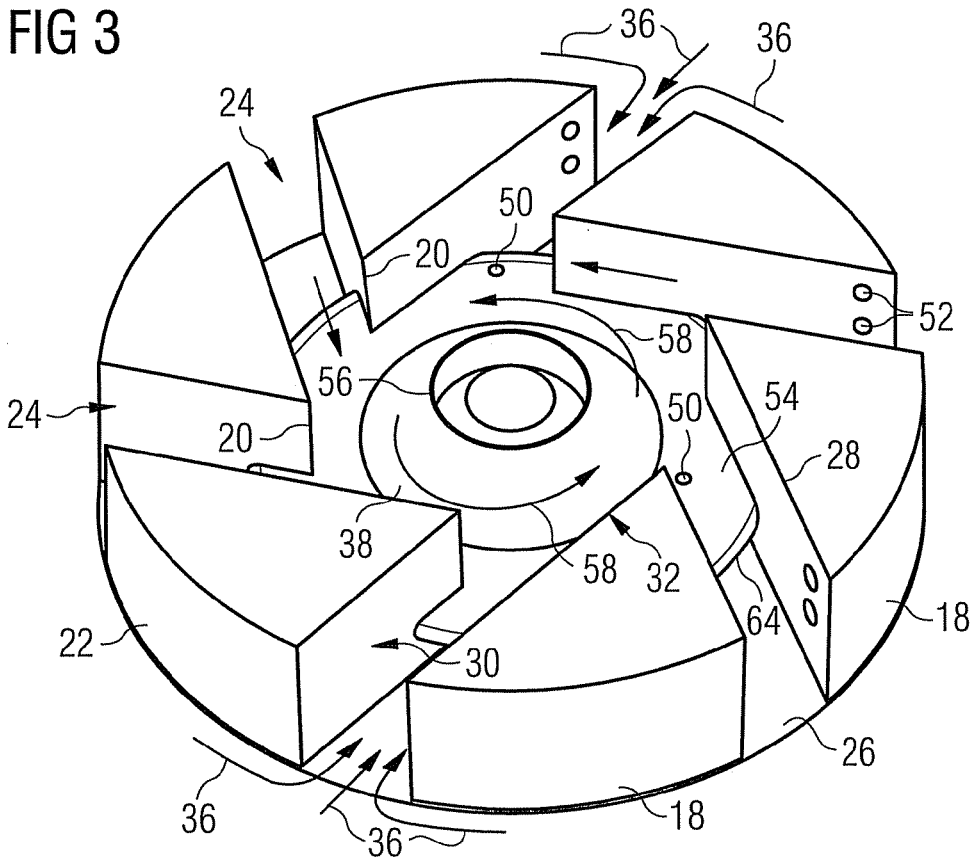
FIG. 3 is a perspective view of a radial swirler and a prefilming device employed in the burner of FIG. 2.

Referring now to FIGS. 2 and 3, an axial section of a first embodiment of a burner in accordance with the present invention is illustrated, comprising an outer casing 10, a radial swirler 12, a pre-chamber 14 and a combustion chamber 16.

Radial swirler 12 comprises a plurality of wedge-shaped vanes 18 arranged in a circle. The thin ends 20 of the wedge-shaped vanes are directed generally radially inwardly. The opposite, broad ends 22 of the wedge-shaped vanes face generally radially outwardly. Flow slots 24, which are directed generally radially inwardly, are defined between adjacent wedge-shaped vanes 18 in the circle. Each flow slot 24 has a base 26 and a top 28 spaced apart in a direction perpendicular to the plane of the circle in which the wedge-shaped vanes 18 are arranged. Each flow slot 24 has an inlet end 30 and an outlet end 32.

Compressed air travels in the direction of arrows 34 in FIG. 2 between outer casing 10 and combustion chamber 16/pre-chamber 14. As indicated by arrows 36, the air then turns through 90 degrees, so as to enter the flow slots 24 at their inlet ends 30. The air then travels generally radially inwardly along flow slots 24. Before the incoming air reaches the outlet ends 32 of the flow slots, it is split into two parallel flows by a prefilming device 38. Thus, part of the incoming air 40 flows on one side of the prefilming device 38, while the other part 42 flows on the other side of the prefilming device, the prefilming device therefore acting as a partitioning device for the flow.

Referring to FIG. 3, liquid fuel is supplied to the swirler through fuel injection holes 50 provided in the wall of the prefilming device 38 facing generally downstream toward the pre-chamber 14. In practice these holes may be formed by nozzles standing proud of the surface of the prefilming device. This liquid fuel, which leaves the holes 50 in a direction roughly orthogonal to the surface of the prefilming device 38, corresponds to a main fuel supply, for use during operation of the burner at high loads. In the illustrated example there are three such holes 50 situated in every second flow slot 24. The actual number used will depend on the size of the burner, expected load conditions, and so on. A secondary main fuel supply in the form of gaseous fuel is provided to each flow slot 24 by way of two fuel injection holes 52 provided in one side of each wedge-shaped vane 18. The air/fuel mix enters the central space 54 (see also FIG. 2) within the circle of wedge shaped vanes 18 downstream of the lip 56 of the prefilming device 38 generally in the direction indicated by arrows 58 (see FIG. 3), thereby forming a swirling air/fuel mix 60 (see FIG. 2) in central space 54. As indicated by arrows 62, the swirling air/fuel mix 60 travels axially along pre-chamber 14 to combustion chamber 16, where it combusts.

Figure 4:
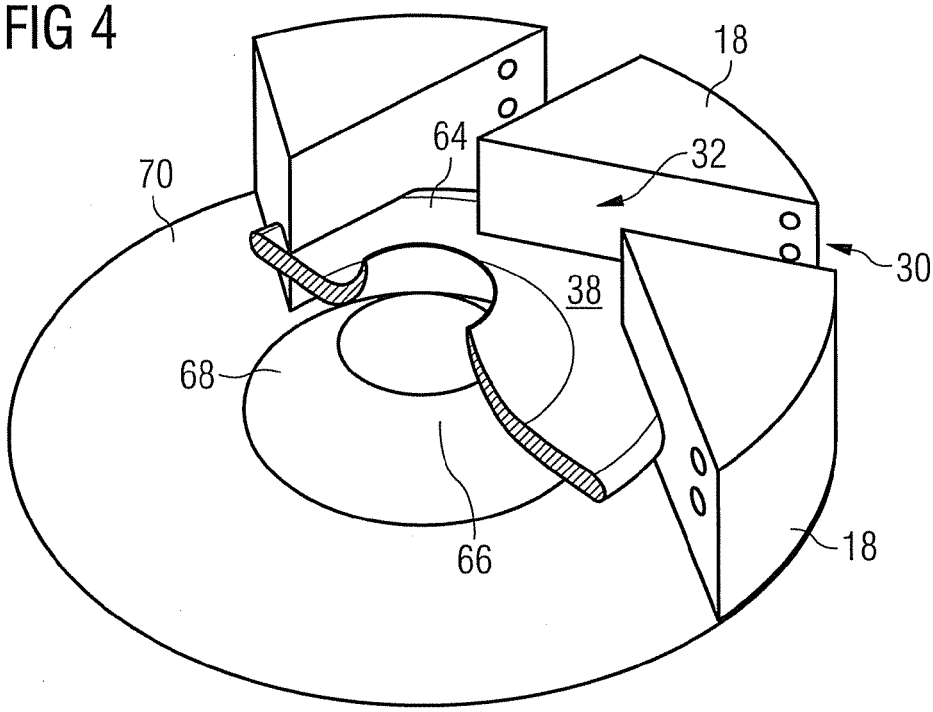
FIG. 4 shows a sectional perspective view through the swirler and prefilming device of FIG. 3.
Figure 5:
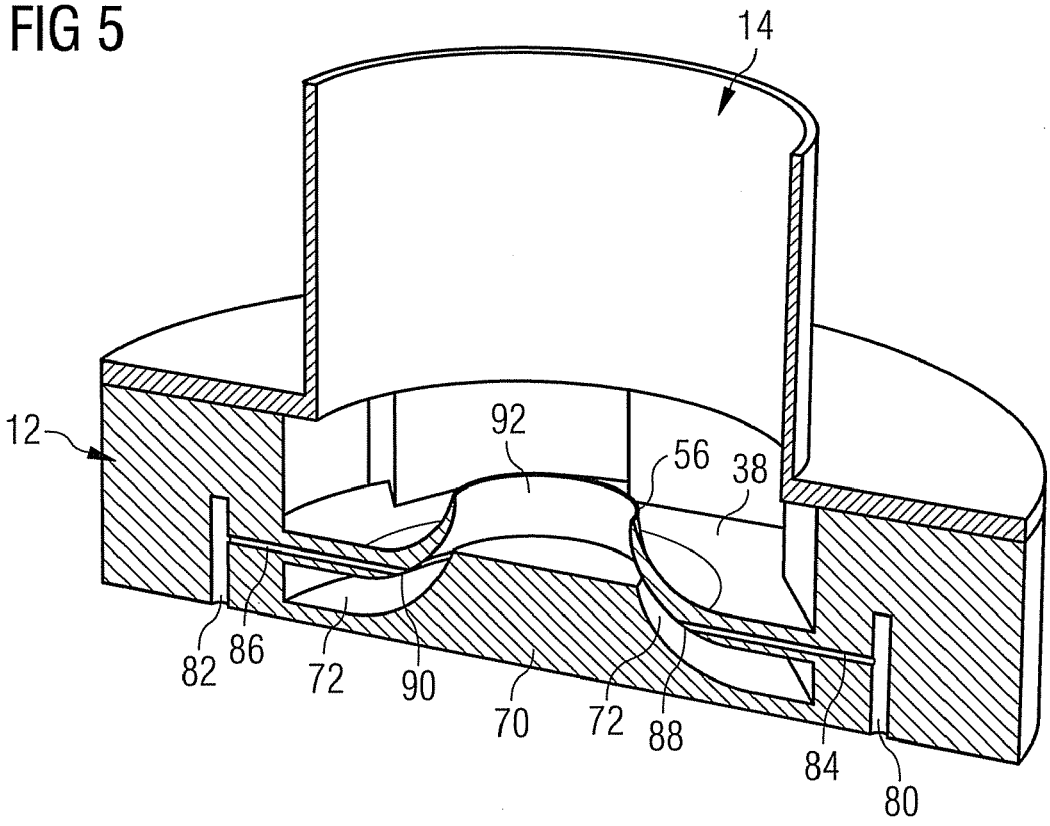
FIG. 5 shows a further sectional perspective view through the swirler and prefilming device of FIG. 3.

Referring now to FIG. 4, which is a sectional perspective view through the swirler and prefilming device, and to FIG. 5, the prefilming device 38, which is circular in profile, is mounted with its outer edge 64 disposed at a point intermediate the inlet and outlet ends 30, 32 of the swirler vanes 18. The prefilming device has a curved surface 66 which, when combined with a similarly curved surface 68 on a base assembly 70, provides a guide for air flowing though the passage 72 formed by these curved surfaces. This passage 72 has a cross-sectional area which decreases in a direction generally toward the pre-chamber 14.

Liquid fuel, corresponding to a pilot fuel supply, is provided to the upstream-facing surface of the prefilming device. This is shown in FIG. 5, which gives a sectional perspective view of the swirler 12, prefilming device 38, base assembly 70 and pre-chamber 14. The liquid fuel is directed through generally axially oriented fuel-inlet passages 80 and 82 into cross-drilled holes 84 and 86. The fuel emerges from these holes at ports 88 and 90 and, through the action of the incoming air 42 (see FIG. 2), forms a thin film on the upstream-facing surface 92 of the prefilming device 38. The fuel flows over this surface 92 to the lip 56, whereupon it breaks up into small droplets through the interaction of the two air flows 40, 42.

Figure 6:
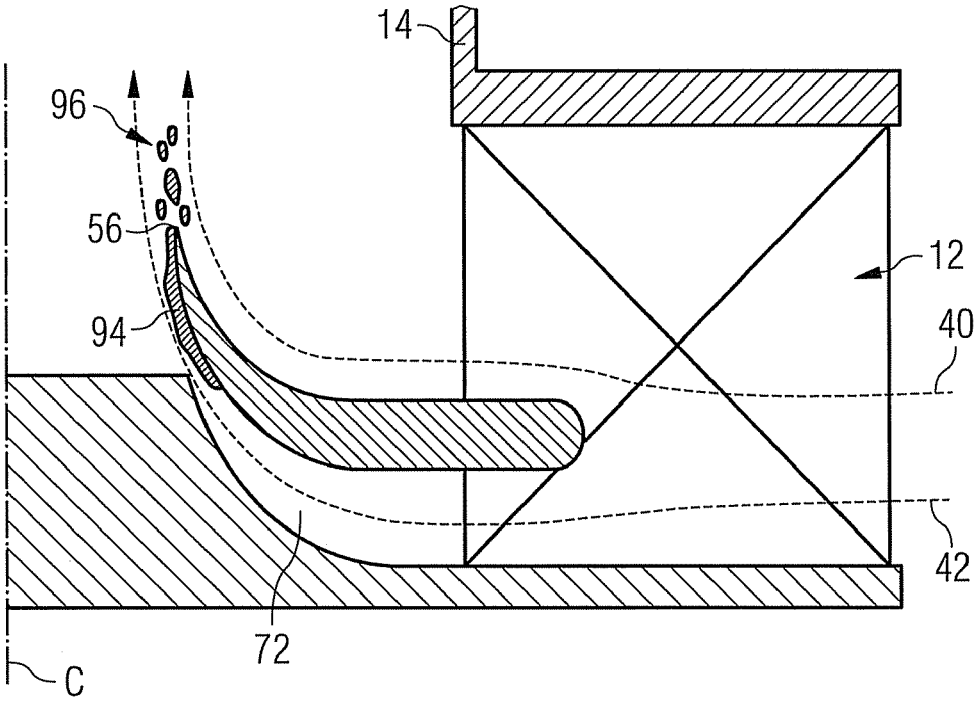
FIG. 6 is an enlarged axial section of part of the burner of FIG. 5 showing the formation of a fuel film on the prefilming device.

FIG. 6 provides a more detailed cross-sectional view through a part of the burner and shows the swirler 12, the start of the pre-chamber 14, the fuel film 94, the passage 72 and the atomised fuel droplets 96. Air streams 40 and 42 act to atomise the fuel at the lip 56 of the prefilming device by virtue of the shear force created by the higher velocity of the air flow 42 relative to that of the air flow 40. This higher velocity is due to a number of factors, one of which is the difference in curvature of the upstream- and downstream-facing surfaces of the prefilming device. The upstream-facing surface forming one wall of the passage 72 is convex, which results in a higher near-surface fluid velocity compared with the concave downstream-facing surface. A more major factor is the mode of operation of the swirler. The swirling flow of the fuel-air mixture has a tangential component. This tangential momentum is preserved, due to the laws of continuity and conservation of energy. This means that those parts of the swirling flow having a smaller radius—this includes the flow 42 in FIG. 6—have a higher velocity. Consequently a radially inner low-pressure region is formed. This plays an important role in the operation of the invention, as will now be described.

Figure 7:
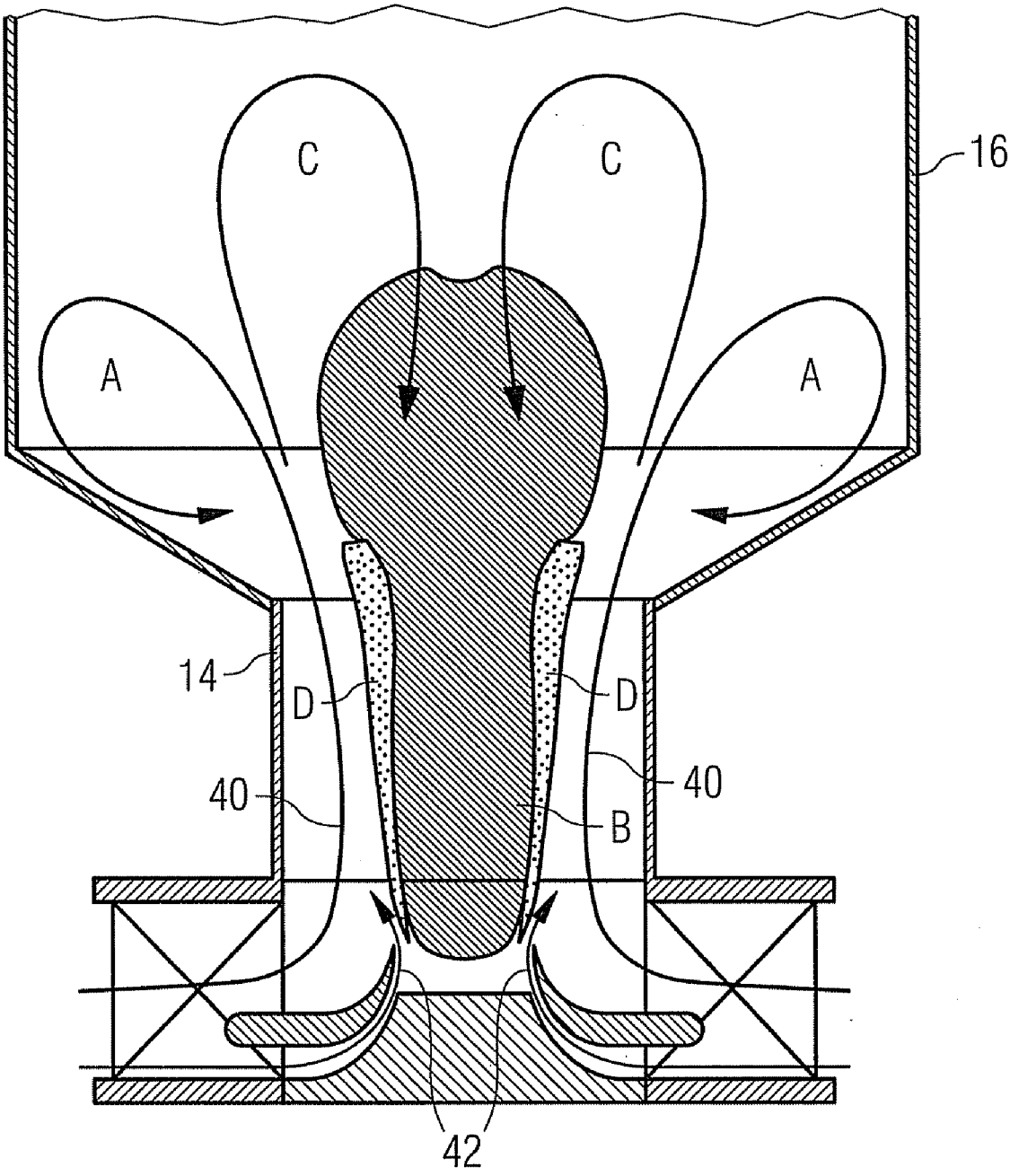
FIG. 7 is a section through an axial plane of a burner in accordance with an embodiment of the present invention, and showing the principle air-flow patterns inside the burner.

Turning now to FIG. 7, FIG. 7 shows the main air flows in the combustor. These flows include, as already explained, flows 40 and 42, which form the base of the swirling fuel-air mix 60 (see FIG. 2) and proceed as a swirling column in an axial direction along the pre-chamber 14 and into the start of the combustion chamber 16. This swirling, axially proceeding flow then experiences combustion, whereupon it gives rise to combustion products. The flow experiences a split, one part of the flow breaking off radially outwardly as flow A, the other part breaking off radially inwardly as flow C. Flow C results in a flow of combustion products, which proceed in a generally axial direction back toward the prechamber 14. This is due to the afore-mentioned region of low pressure B, which is a result of the operation of the swirler and acts to draw the flow C back toward the swirler, as the flow loses its axial momentum. Hence two contrary flows now exist: the downstream-proceeding flow arising from flows 40 and 42 and the upstream-proceeding return flow arising from flow C. This results in a generally cylindrical region of high shear shown as region D in FIG. 7. (It is assumed here that the prechamber is approximately cylindrical in form). The high shear force in region D acts on the already atomized fuel exiting the lip 56 of the prefilming device 38, thereby causing a secondary atomization of the existing fuel droplets. This occurs since the local Webber number in this region will be very high. It can therefore be seen that atomization in this embodiment of the present invention occurs in two stages: firstly, the primary atomization due to shear between flows 40 and 42 and secondary atomization due to shear between flow C and flows 40 and 42. This increases the efficiency of the atomization process. In particular, it helps in the atomization of fuels with higher viscosity than standard fuels, such as diesel and kerosene. Good atomization is helpful in reducing undesirable emissions, in particular NOx.

To assist in the secondary atomization process, it is preferable if the lip 56 of the prefilming device is located at least at the start of the high-shear region D, as shown in FIG. 7, and more preferably at some point within this region. However, even if the lip is only adjacent the start of region D, the velocity at which the fuel film will be travelling will allow it to jump into this region and experience secondary atomization. To achieve any of these scenarios, it is necessary to assess where in the burner the high-shear region D will occur. In practice, this can be done by calculation, numerical modelling and/or experimentation. More specifically, data including the burner dimensions, swirler characteristics, incoming fuel pressure, etc, can be used as variables in a mathematical modelling algorithm, which will provide information on the location of the high-shear region. More specifically still, it is possible to derive values of axial velocity or momentum of the flow within the prechamber 14 at various radial positions starting from the centreline (longitudinal axis) of the burner and for various slices along that centreline. Firstly, we assume that the prefilmer is at a certain position in the swirler, e.g. as shown in FIG. 7, with the lip situated at a given plane along the longitudinal axis of the burner. We then start just downstream of this given lip position and proceed along the centreline, taking radial values of axial velocity as we proceed. Eventually we come to a point at which the flow momentum or velocity changes sign. This is because the flow is first of all purely in a downstream direction (flows 42 and 40), but then flow C starts to have effect, which causes the flow nearer the centreline to proceed in an upstream direction. Hence there is a change in sign. This will establish the start of the high-shear region and the point at which the prefilmer lip should actually be placed (or the lip could, as already mentioned, be placed somewhat further downstream within the high-shear region). To ensure that the lip is not placed outside the high-shear region at the downstream end, further measurements of axial velocity or momentum could be taken proceeding further downstream along the centreline. If this is continued, of course, eventually the finishing point of the high-shear region D would be reached.

If the starting point of the high-shear region at the upstream end cannot be ascertained, this would mean that the assumed starting position for the prefilmer lip was too far downstream. The measurements would therefore be repeated with the lip further upstream.

The axial velocity/momentum measurements can be taken either by simulation or by actual experiment. As regards experimentation, the aerodynamic flow field can be measured using laser doppler velocimetry, which is a non-intrusive technique that can measure all three of the velocity components of a seeded air flow, including the axial component. Generally, this is done with a non-reacting flow, but the results are still valid for a hot flow, since the reaction will generally increase the axial-velocity vector. In most cases the shear (or difference in velocities) will be so high as to be measureable in cold-flow as well as hot-flow cases. As an alternative to laser doppler velocimetry, it is possible to use hot-wire anemometry. This, however, is intrusive and would not give the level of fine detail which might be desirable in some situations.

The effectiveness of the two-stage atomization process just described is enhanced by the fact that the low pressure in region B also acts to increase the air flow 42. This further assists the prefilming action, whereby the fuel leaving ports 88, 90 on the surface of the prefilming device 38 (see FIG. 5) is spread axially along that surface up to the lip 56 of the prefilming device. It also increases the efficiency of the primary atomization process by increasing the shear force between flows 40 and 42.

Figure 8A:
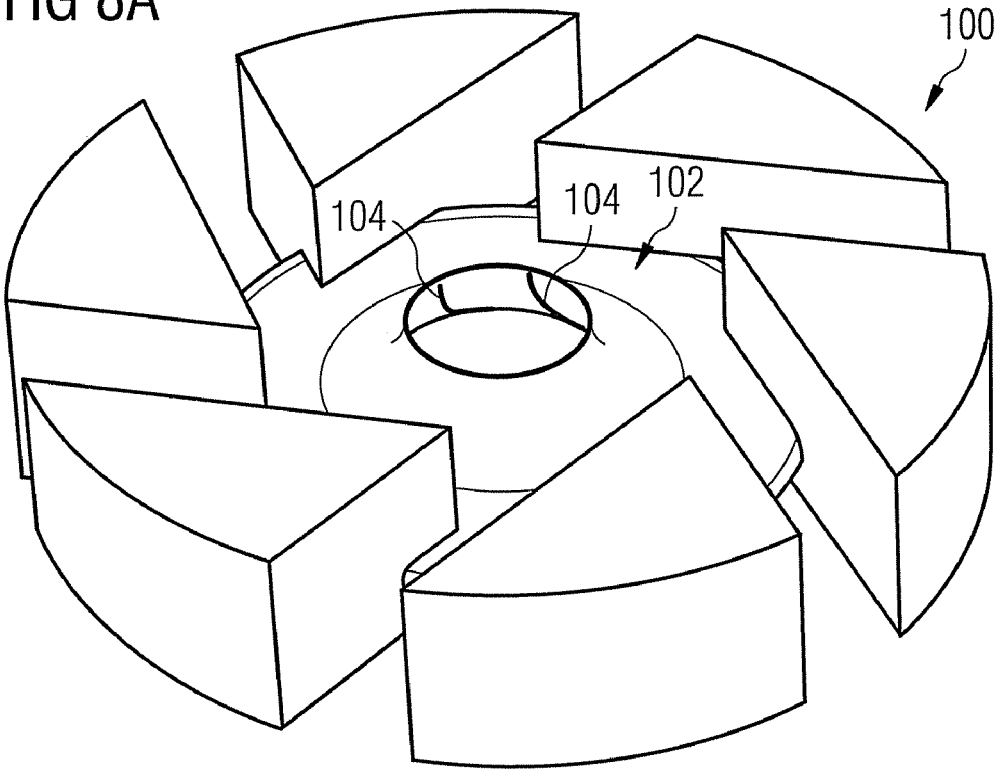
FIGS. 8(*a*), 8(*b*) and 8(*c*) are perspective views of a swirler and prefilming device as employed in a second embodiment of a burner in accordance with the present invention.
Figure 8B:
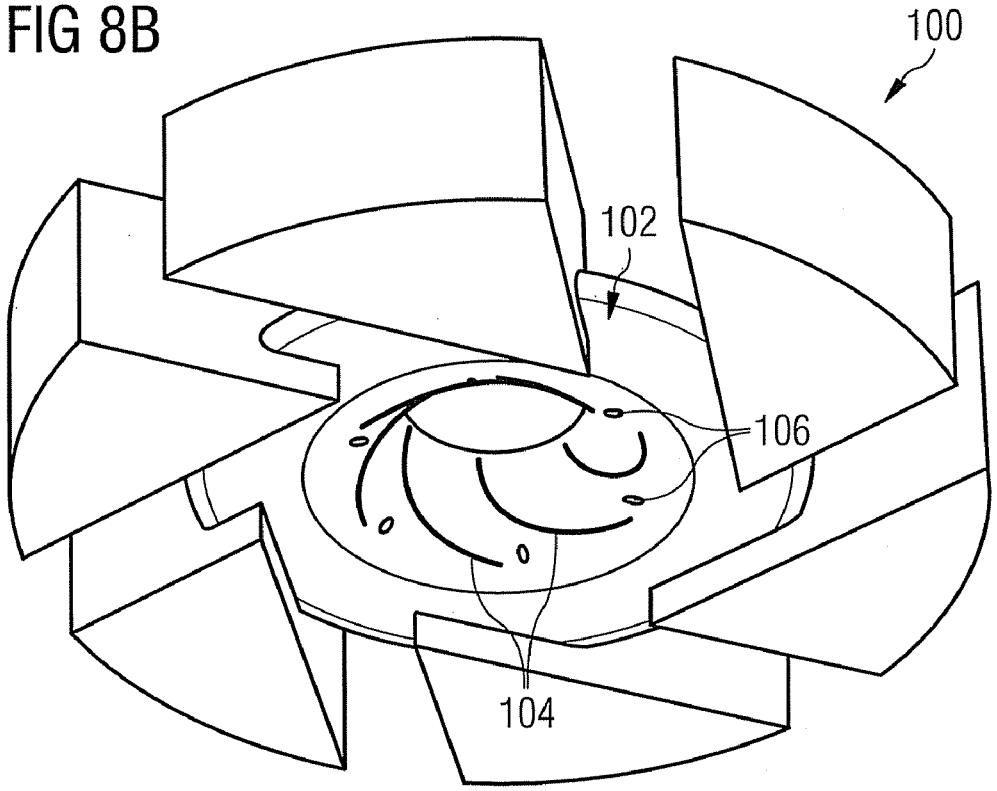
Figure 8C:
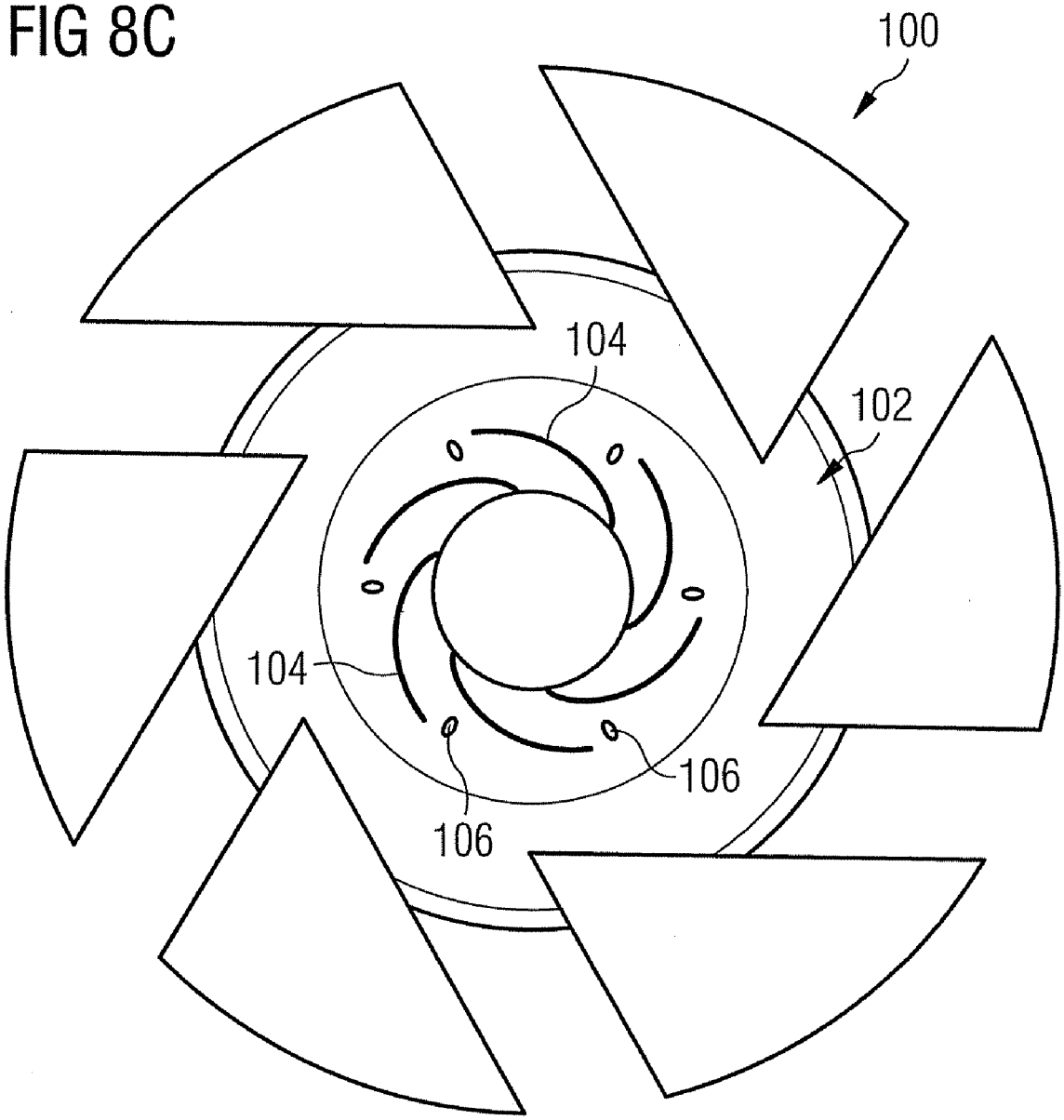

A second embodiment of the invention will now be described with reference to FIGS. 8(*a*)-8(*c*). FIGS. 8(*a*)-8(*c*) are various perspective views of a swirler and prefilming-device combination. More precisely, FIG. 8(*a*) is a view from the downstream pre-chamber end of the burner, while FIGS. 8(*b*) and 8(*c*) are views from the upstream end of the burner, i.e. from the base 70 shown in FIG. 5. Both the swirler 100 and the prefilming device 102 are as described in connection with the first embodiment. Thus the upstream surface of the prefilming device is equipped with liquid-fuel ports 106. The main difference with respect to the first embodiment is that the prefilming device 102 has on its upstream surface a series of circumferentially spaced-apart surface features 104. These features may be constituted as either grooves or ridges. These grooves or ridges follow the curvature of the prefilming-device surface and at the same time follow the helical swirl path of the incoming air and fuel.

The effect of such grooves or ridges is that some of the fuel leaving the fuel ports 88, 90 (see FIG. 5) tends to accumulate in the grooves or on the ridges, forming a discrete flow of fuel having a film thickness greater than that on the rest of the upstream surface of the prefilming device. This means that the fuel leaving the lip 56 at the ends of these grooves or ridges will have a significantly larger droplet size than the rest of the fuel leaving the lip. This, in turn, will have the result that the time for these larger droplets to break up under secondary atomization in the high-shear region D (see FIG. 7) will be increased, resulting in a more spread-out axial distribution of fuel within region D in those discrete locations. (The droplets reduce in size progressively after each shattering in the high-shear region D). This helps to counteract what might otherwise be a circumferentially uniform very high concentration of fuel immediately downstream of the lip 56, since it changes the local fuel-air ratio within this region. The main benefit of this arrangement is that different atomization characteristics are produced in different parts of the flow field, which in turn means different time delays, i.e. the delay between the time the fuel is injected and the time it is ignited. Hence there is provided a local control of heat release in space and time, which can help to avoid high levels of combustion instability. It is only necessary to provide small, but precise, distortions of the fuel distribution, in order to reduce such instability, and the use of grooves or ridges in this manner is sufficient for this purpose.

Figure 9A:
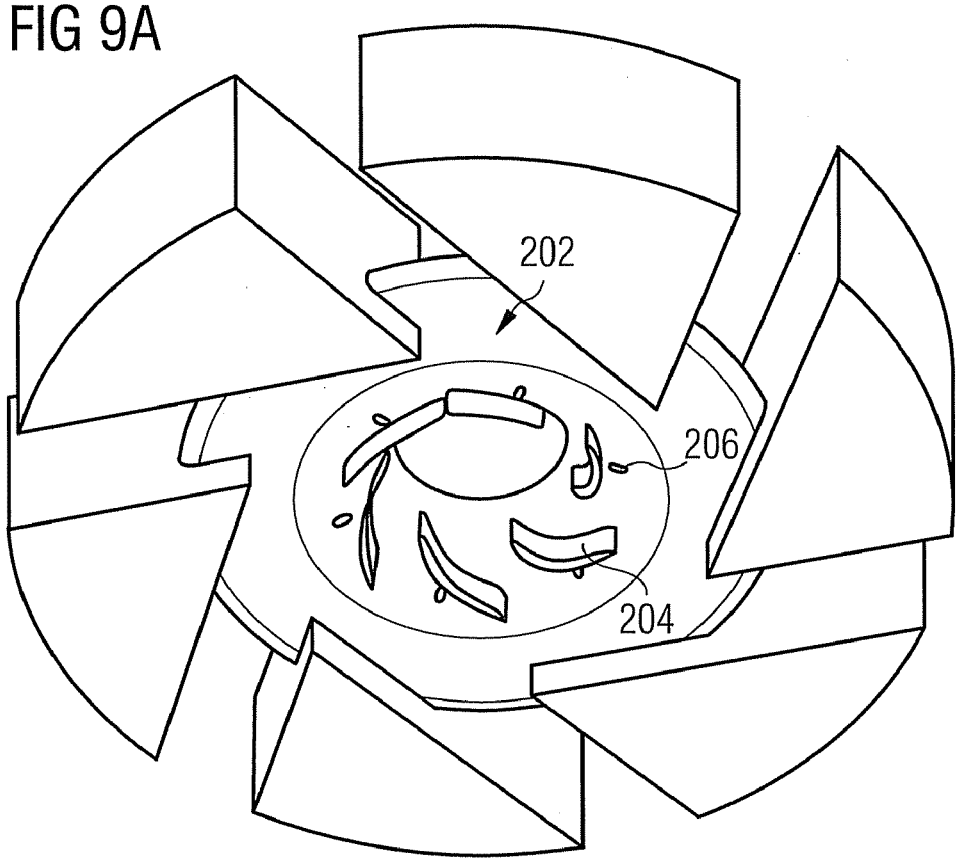
FIGS. 9(*a*) and 9(*b*) are perspective views of a swirler and prefilming device as employed in a variant of the second embodiment of the present invention.
Figure 9B:
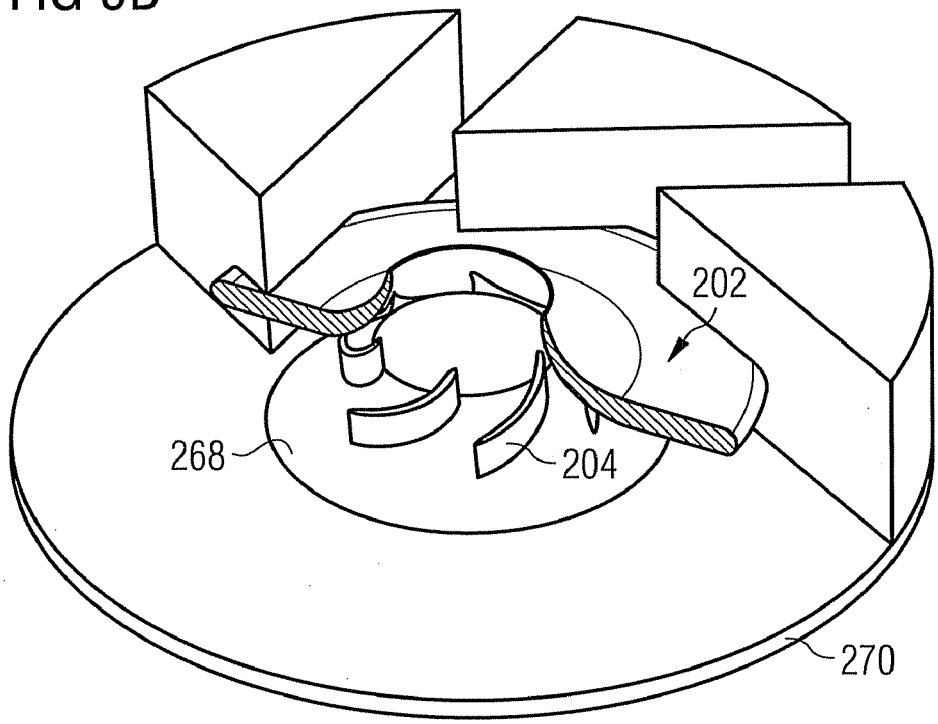
Figure 10A:
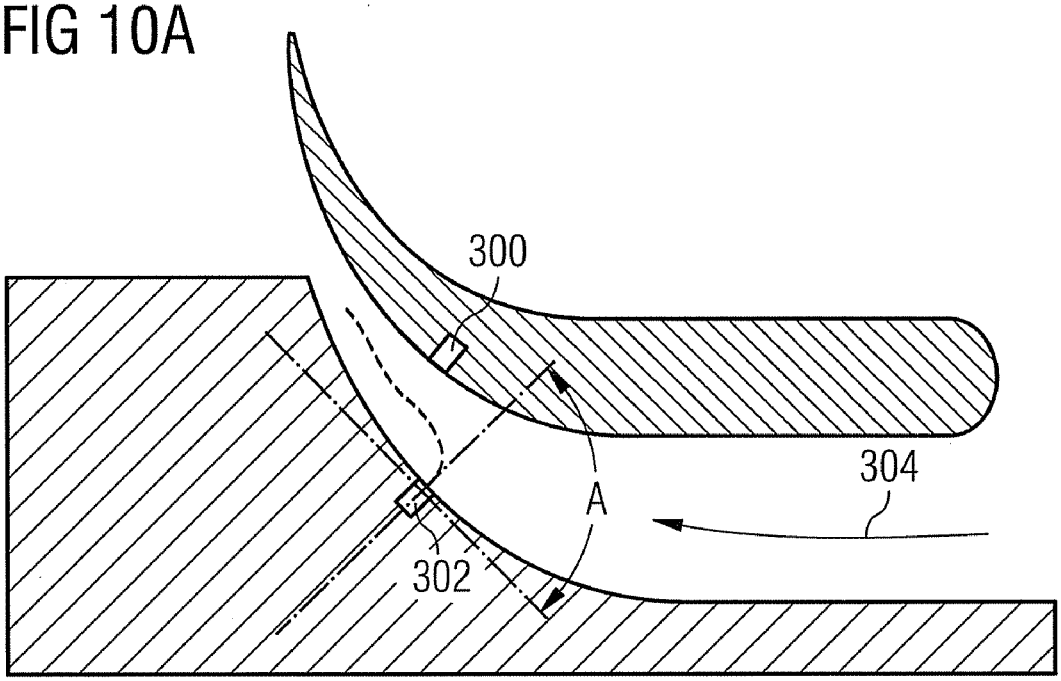
FIGS. 10(*a*)-10(*e*) are sectional views of part of the prefilming device and the burner base in a further realization of a burner in accordance with the present invention.
Figure 10B:
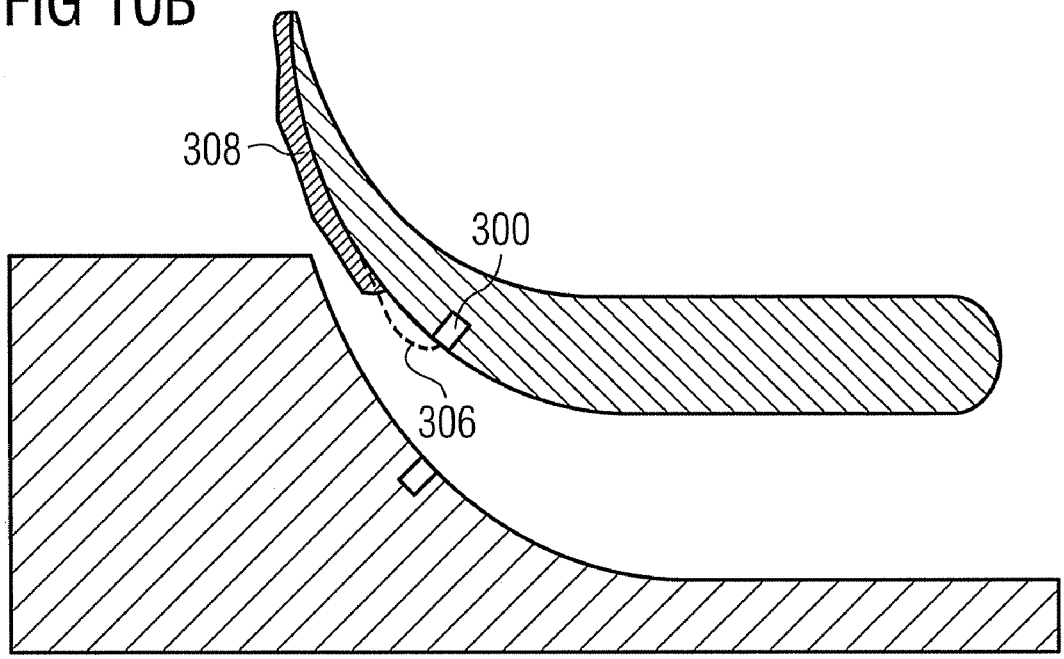
Figure 10C:
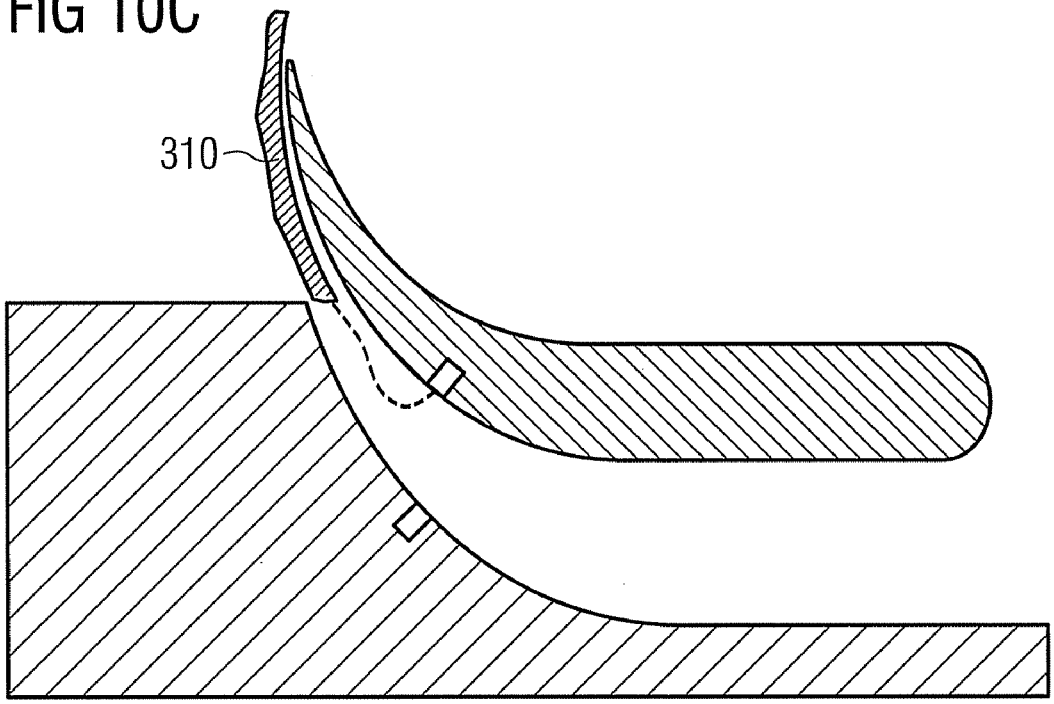
Figure 10D:
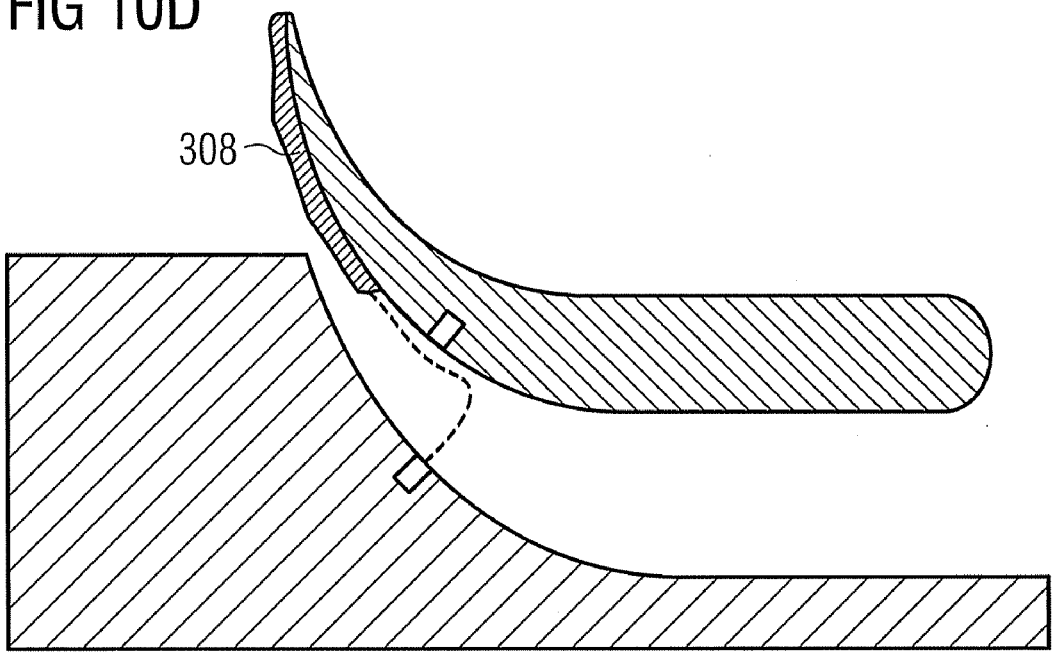
Figure 10E:
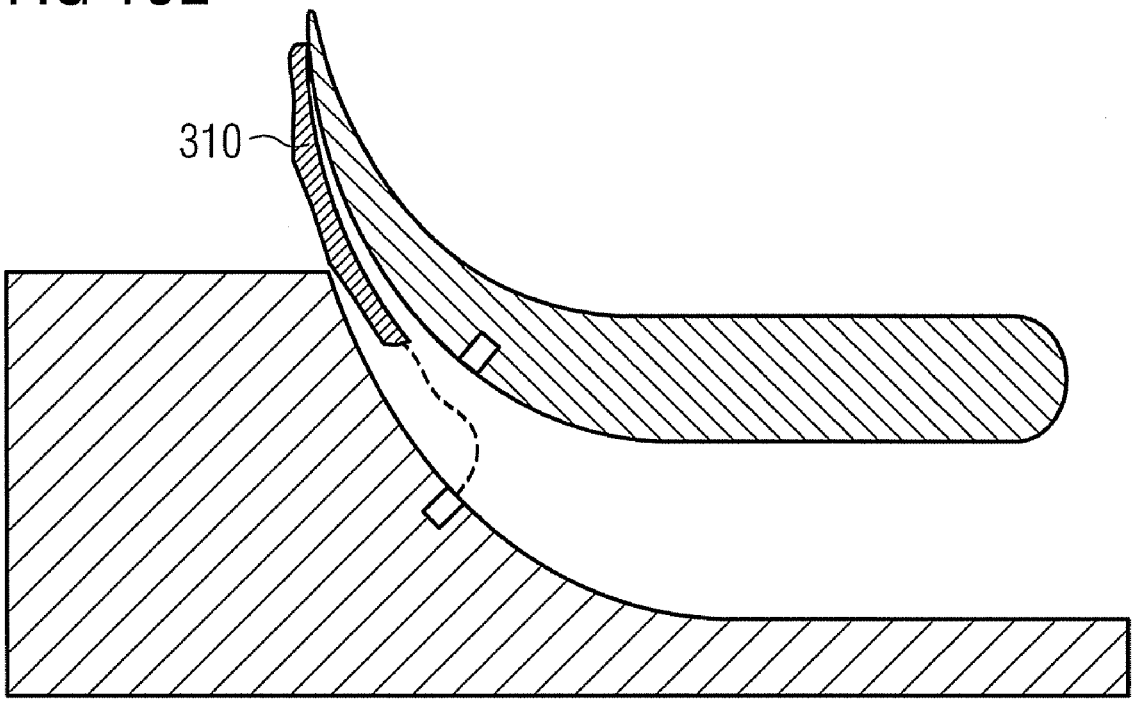
Figure 11A:
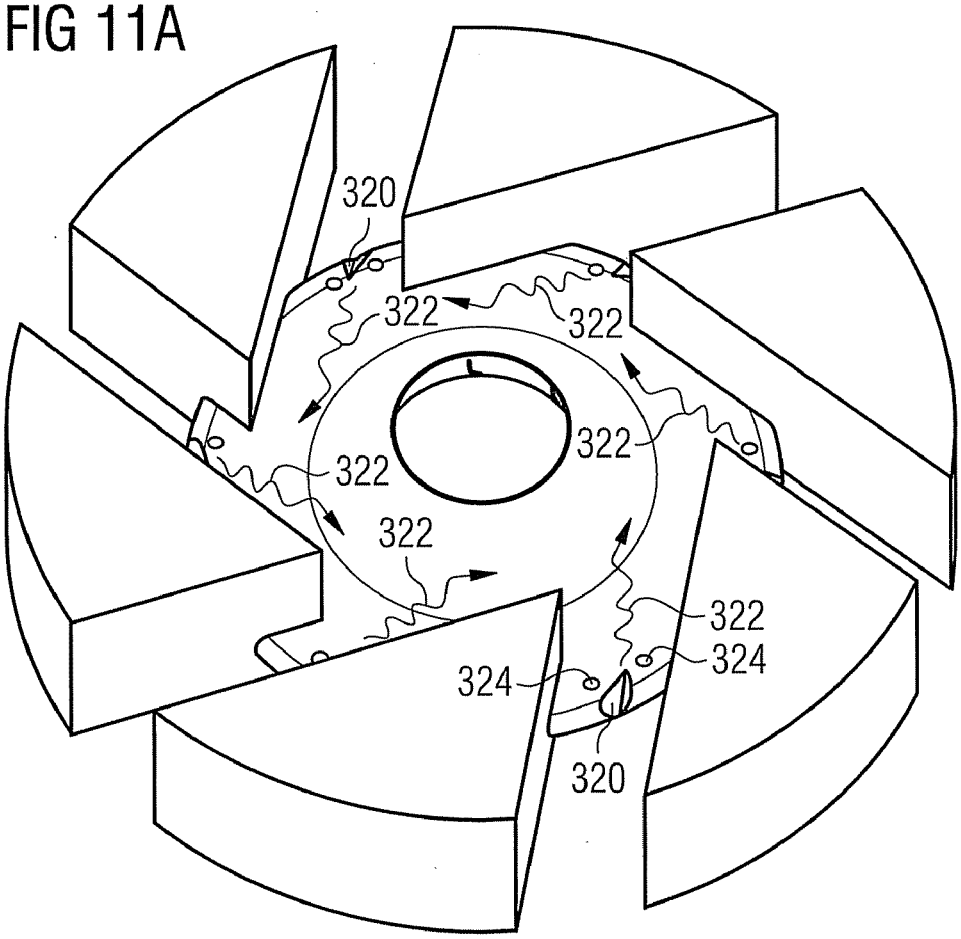
FIGS. 11(*a*)-11(*d*) are perspective views similar to that of FIG. 3 and illustrating a still further realization of a burner in accordance with the present invention.
Figure 11B:
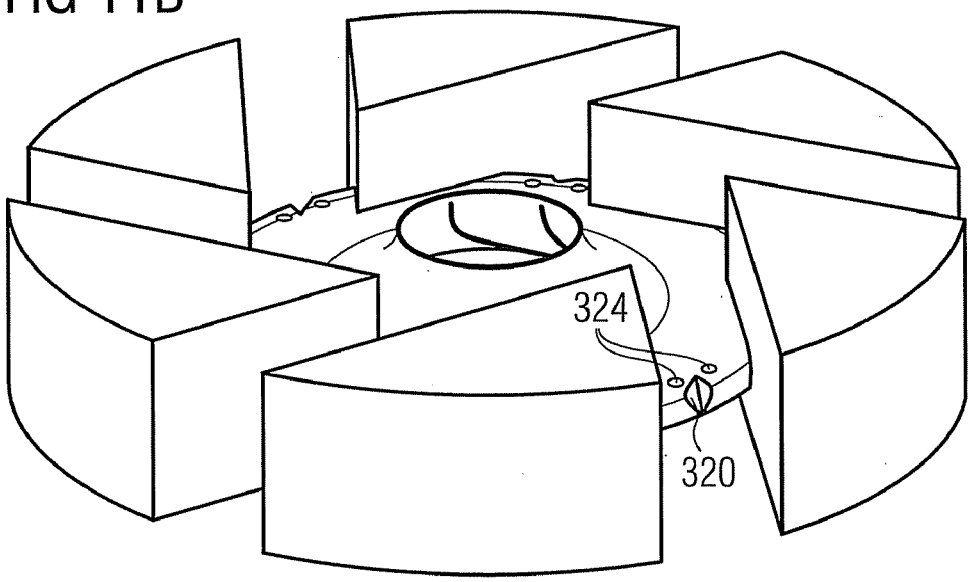
Figure 11C:
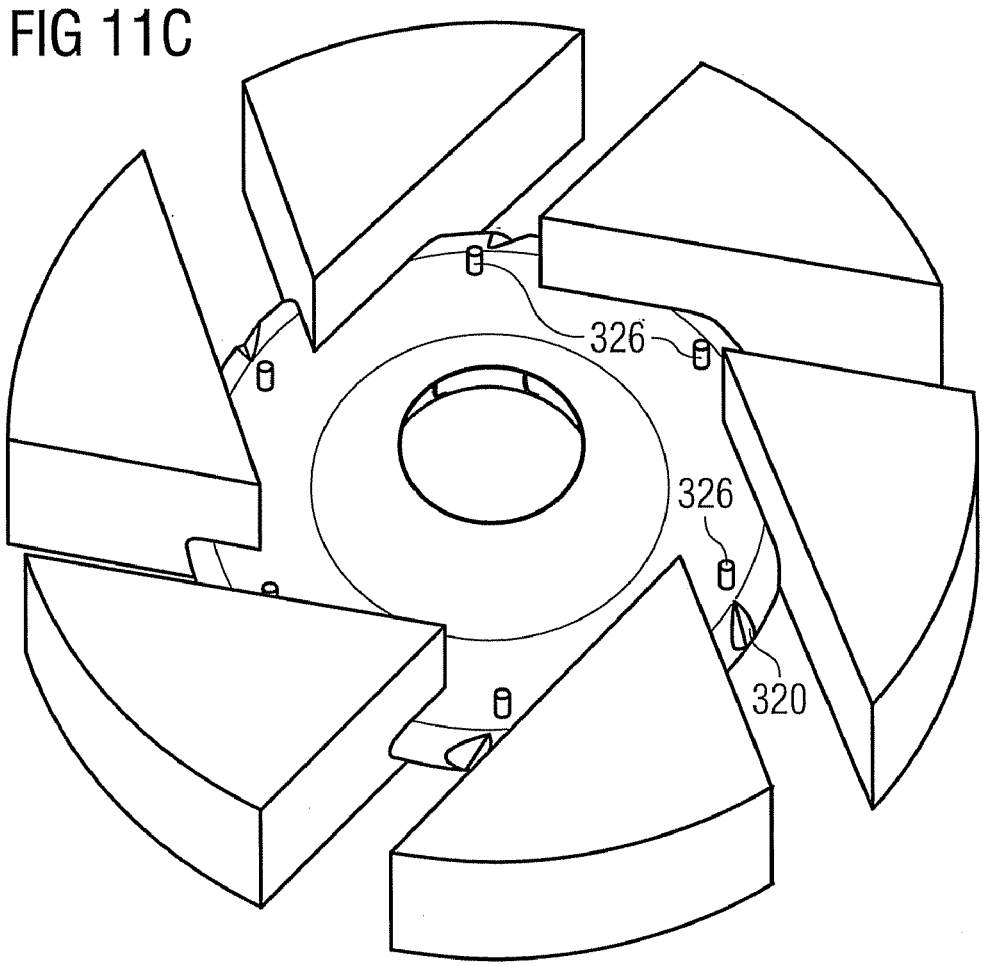
Figure 11D:
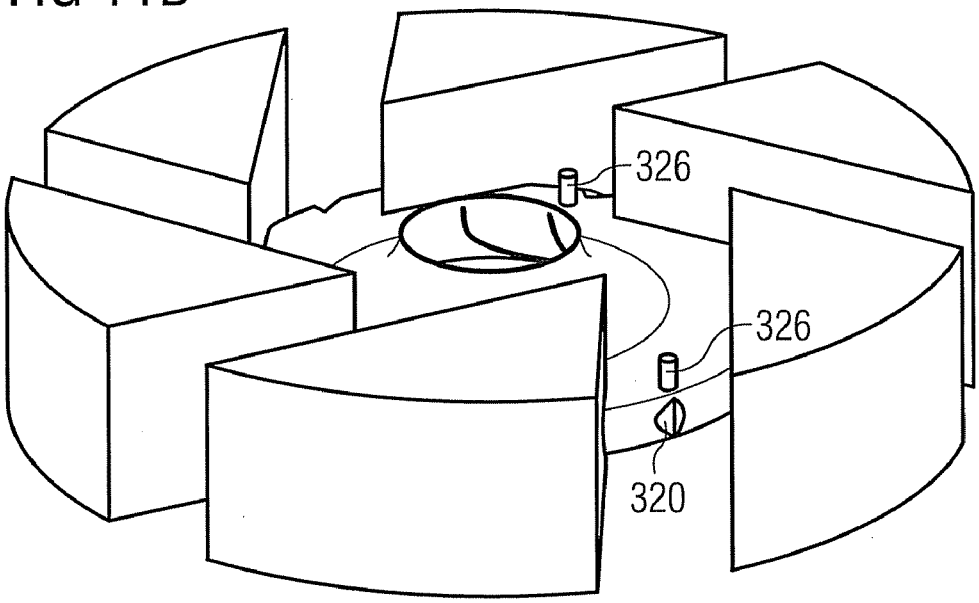

A variant of the second embodiment just described is illustrated in FIGS. 9(*a*) and 9(*b*). FIG. 9(*a*) is a view from the upstream side of the prefilming device (i.e. from the base of the burner), while FIG. 9(*b*) is a view from the downstream side (i.e. from the prechamber). In this variant the ridges are constituted by a set of small curved vanes 204 located in the space between the upstream surface of the prefilming device 202 and the curved surface 268 of the base assembly 270. These vanes, which may be secured to either of these curved surfaces and do not necessarily extend all the way between them, form separate flow passages. These passages induce more or less swirl within the prefilming device, and this changes the concentration of the fuel in a manner similar to that achieved by the embodiment shown in FIG. 8.

Whereas FIG. 5 showed the use of two liquid-fuel inlet ports 88, 90 in the prefilming device, in practice more inlets could be used, for example to provide staging of the fuel flow into the combustor during operation of the gas turbine. This may be, for example, during operation at reduced load, or when more than one type of fuel is used—e.g. a liquid and a gaseous fuel. Where the invention is employed in, for example, a reciprocating-engine application, two fuels are sometimes used at the same time, one or both of which is liquid. In the latter case, one liquid fuel is heavier than the other. The lighter fuel is used to ignite and evaporate the heavier fuel, which may be, e.g., a heavy heating oil. Where the application is a gas-turbine engine, in which heavy fuels are not employed, it may be desired to co-fire a bio fuel, such as alcohol, and a fossil fuel, such as diesel.

The embodiments so far described have involved the use of a prefilming device. This, however, is not essential to the invention. The advantage of using such a device is that it constitutes a convenient means of injecting fuel directly into the high-shear region D shown in FIG. 7. The primary atomizing effect of the prefilming device is also not essential to the operation of the invention, though it can be beneficial, since it can help to reduce the very high fuel density, which might otherwise occur in the injecting region. Also, as has been described in connection with FIG. 8, it is relatively straightforward to provide means in the prefilming device (e.g. grooves, ridges or vanes), which result in the injection of circumferentially controlled streams of large (liquid) fuel droplets into the high-shear region. This, as already mentioned, provides control over the axial distribution of fuel in the high-shear region. In summary on this point, therefore, the present invention relies on the action of secondary atomization in the high-shear region, not atomization due to the use of a prefilmer.

Instead of a prefilming device, an annular member could be used, for example. Such a member (not shown) would be situated at or near to the start of the low-pressure region B and the start of the high-shear region D and would have one or more fuel ports around its circumference facing generally downstream toward the combustion chamber. Of course, it would be necessary to provide some means of anchoring the annular member to the burner, preferably in a manner causing little resistance to the swirling flow proceeding axially toward the combustion chamber 16.

As an alternative to placing the fuel ports 88, 90 on the upstream-facing side of the prefilming device, they may be placed on the downstream-facing side. A drawback with this, however, is that the fuel leaving these ports would be exposed to high levels of flame radiation and, as a result, be likely to pyrolise, so that the ports could become blocked after a short while.

A further alternative is to locate these ports on the curved surface 68 (see FIG. 4) either instead of on the prefilming-device surface or in addition thereto. An example of such an arrangement is shown in FIGS. 10(*a*)-10(*e*). FIG. 10(*a*) shows two sets of ports, a first set 300 in the prefilming-device surface and a second set 302 in the base surface. The first set 300 corresponds to the ports 88, 90 shown in FIG. 5. Each of these sets of ports can inject fuel at an angle A to a tangent at the point of the respective surface at which these ports are located. The ports may also be inclined at an angle to the plane of the paper in FIG. 10(*a*). This diagram shows, as an example, fuel being released from port 302 into the air passage between the prefilming device and the base. This fuel stream is broken up by the cross-stream of air 304 flowing through this passage.

In a first scenario (see FIGS. 10(*b*) and 10(*c*)), which corresponds to the situation already described in conjunction with FIG. 5, etc, fuel (assumed here to be liquid fuel) is injected from the wall of the prefilming device only. During starting of the gas-turbine machine (see FIG. 10(*b*)), of which it is assumed that this burner forms a part, the flow rate of the fuel is very low and therefore the fuel 306 injected from port 300 spills onto the prefilming-device surface without significantly penetrating into the air passage. This is because of the low momentum of this fuel. The fuel forms a film 308, which atomises as already described in connection with the earlier embodiments. As the machine is run up towards full power (see FIG. 10(*c*)) the fuel supply pressure increases, which increases the injection momentum of the fuel. At this point the fuel is able to penetrate deeper and mix with the air in the air passage and so atomization and vaporization can occur, producing a partially premixed and pre-vaporized fuel-air mixture. As the machine power is further increased, the flow of the fuel in ports 300 and 302 may be reduced, reproducing the situation shown in FIG. 10(*b*). This is possible, because the bulk of the fuel will be taken over by the main fuel supply provided, for example, by way of holes 50 and 52 shown in FIG. 3.

FIGS. 10(*d*) and 10(*e*) show a scenario, in which the ports 302 are used instead of the ports 300. In FIG. 10(*d*) at low engine power pilot fuel is injected into the air passage, so that it impinges on the surface of the prefilming device, thereby forming the film 308. At higher engine loads the fuel injection is backed off so that, as in FIG. 10(*c*), a partially premixed and pre-vaporized fuel-air mixture 310 is produced. The problem with this scenario is that it is not optimal for starting conditions of the engine, since the injection momentum may not be high enough to penetrate deeply into the air flow and form the film 308. In this case several ports could be mounted on the surface of the base member. Flow through these ports would be staged to ensure or control the placement of fuel into the air passage.

As already mentioned, it would be possible to employ both sets of ports 300, 302 at the same time. In this case, for example, set 300 could be used at starting/low-load conditions, where fuel momentum was low, and set 302 could take over at higher load conditions, as shown in FIG. 10(*e*).

The injection device used to form the ports 300, 302 may be either a plain hole in a nozzle or a pressure type of device, such as a simplex atomizer.

In order to enhance the mixing of fuel and air in the swirler, an arrangement such as that illustrated in FIGS. 11(*a*)-11(*d*) may be employed. In this arrangement (see FIGS. 11(*a*) and 11(*b*)) a notch 320 is cut into the upper surface of the leading edge of the prefilming device. This notch produces a flow discontinuity, which generates a longitudinal vortex 322. The vortex assists in the mixing of the fuel, which is injected from the holes on the upper surface of the prefilming device. In contrast to the arrangement shown in FIG. 3, the holes 324 in this arrangement are located nearer the notch and preferably on each side of it. In the illustrated arrangement, a notch is provided at each swirler slot. This is advantageous as far as gas fuel is concerned. However, when liquid main fuel is being injected, it is better to have a notch at alternate slots, since this assists in the evaporation of the fuel-spray droplets. The air flow on each side of the spray helps the evaporated fuel to be quickly removed and mixed, thereby increasing the rate at which the droplets vaporize.

FIGS. 11(*c*) and 11(*d*) show the equivalent scenario in the case of liquid fuel, injection nozzles 326 being used instead of simple holes 324, as in FIGS. 11(*a*) and 11(*b*). In FIG. 11(*c*) one notch and one nozzle are provided for each flow slot, which—as already mentioned—constitutes a sub-optimal solution for liquid fuel. Preferably every other notch and nozzle is dispensed with, to produce the situation shown in FIG. 11(*d*).

Whereas FIG. 3 showed the presence of fuel ports 52 for the supply of gaseous fuel to the swirler, these may be omitted, depending on requirements, or may be adapted for use as a second source of liquid fuel, additional to the liquid fuel fed through holes 50 (i.e. ports 88, 90 in FIG. 5).

Although the swirler has been represented as a radial swirler, it is possible, in principle, to employ an axial swirler instead.

In what has so far been described, it has been assumed that the prefilming device, or other device performing a similar function in injecting fuel directly into the high-shear region, will be used in conjunction with pilot fuel. It is, however, possible to use the device to inject main fuel, either in addition to pilot fuel or even instead of it. Where all the main fuel is injected via the device, the result will be a so-called diffusion flame, arising from a lack of premixing in the burner.

The invention claimed is:

1. A burner for a gas turbine engine, comprising:

a swirler providing a swirling mix of air and fuel, and a combustion chamber for a combustion of the swirling mix of air and fuel, the swirler comprising:

a plurality of vanes arranged in a circle, a plurality of flow slots, each flow slot defined between two adjacent vanes and has an inlet end and an outlet end, and a fuel-placement device, arranged to deposit a first supply of fuel in the form of a liquid fuel in a high shear region between two adjacent flows in the burner;

wherein, in operation, air travels along each flow slot from the inlet end to the outlet end, and a second supply of fuel is supplied to the plurality of flow slots, whereby the swirling mix of air and fuel that is annular in form travels away from the swirler toward the combustion chamber, wherein the high-shear region is a result of a creation of a low-pressure region by the swirler, and wherein the two adjacent flows are an aimular swirling mix of air and fuel which is located radially outside the low-pressure region and a counter-flow located inside the swirling mix of air and fuel created by the low-pressure region, wherein the counter-flow is generally toward the swirler and away from the combustion chamber, wherein the first supply of fuel in the form of liquid fuel from the fuel-placement device is subjected to an atomisation due to a high shear from the high shear region, wherein the fuel-placement device is also a partitioning device, whereby a flow of air along each flow slot is divided into a first air flow and a second air flow, wherein the burner includes a fuel-supply port for supplying the first supply of fuel in the form of liquid fuel to the first air flow or the second air flow, wherein when the burner is operating, the first air flow or the second air flow to which the liquid fuel was supplied causes the liquid fuel supplied to form a film of fuel over a first surface of the fuel-placement device, wherein the first surface is located in the plurality of flow slots, and wherein the fuel-placement device is arranged so that the film substantially leaves the first surface in the high-shear region, wherein the fuel-placement device further includes a second surface, wherein the fuel-placement device extends radially in a region adjacent to the first surface, then curving in an increasingly axial direction towards the second surface, wherein the base member is curved similarly to the fuel-placement device so that a passage is created between the fuel-placement device and the base member, and wherein a cross-sectional area of the passage decreases in a direction of flow of an incoming air.

2. The burner as claimed in claim 1, wherein the low pressure region is located inside the swirling mix of air and fuel.

3. The burner as claimed in claim 1, wherein the fuel-placement device is located at a point between the inlet end and the outlet end.

4. The burner as claimed in claim 1, wherein the second surface of the fuel-placement device forms a lip located adjacent to, or in, a region occupied by the low pressure.

5. The burner as claimed in claim 4, wherein the fuel-supply port is provided in the first surface of the fuel-placement device.

6. The burner as claimed in claim 5, wherein the fuel-supply port is provided in a surface of the base member facing the fuel-placement device.

7. The burner as claimed in claim 5, wherein the first surface faces the base member.

8. The burner as claimed in claim 1, wherein the swirler is a radial swirler.

9. The burner as claimed in claim 1, wherein the second supply of fuel is in the form of a gaseous fuel, which is provided to each flow slot by two fuel injection holes in a side of each vane.

* * * * *

UNITED STATES PATENT AND TRADEMARK OFFICE

CERTIFICATE OF CORRECTION

PATENT NO. : 8,375,721 B2
APPLICATION NO. : 12/518516
DATED : February 19, 2013
INVENTOR(S) : Nigel Wilbraham It is certified that error appears in the above-identified patent and that said Letters Patent is hereby corrected as shown below:

In the Claims:

In claim 1, col. 9, line 41, please remove [wherein the two adjacent flows are an aimular swirling mix], and insert --wherein the two adjacent flows are an annular swirling mix--

Signed and Sealed this
Ninth Day of July, 2013

Teresa Stanek Rea
*Acting Director of the United States Patent and Trademark Office*